United States Patent [19]

Oates, Jr.

[11] Patent Number: 4,676,181

[45] Date of Patent: Jun. 30, 1987

[54] BOAT STABILIZER

[75] Inventor: Charles P. Oates, Jr., Memphis, Tenn.

[73] Assignee: Tree Lok, Inc., Memphis, Tenn.

[21] Appl. No.: 787,257

[22] Filed: Oct. 15, 1985

[51] Int. Cl.[4] ..... B63B 21/00

[52] U.S. Cl. ..... 114/230; 114/351; 114/364; 248/231

[58] Field of Search ..... 114/230, 351, 362, 364; 248/231

[56] References Cited

U.S. PATENT DOCUMENTS

| | | | |
|---|---|---|---|
| 593,250 | 11/1897 | Stirk . | |
| 1,587,710 | 6/1926 | Fiala . | |
| 1,819,768 | 8/1931 | Coffing | 248/231 |
| 2,526,871 | 10/1950 | Johnson . | |
| 2,794,191 | 6/1957 | Gaskouitz | 114/364 |
| 2,907,294 | 10/1959 | Lawler . | |
| 2,938,492 | 5/1960 | Kulick | 114/230 |
| 2,983,243 | 5/1961 | Bowers et al. | 114/230 |
| 3,108,563 | 10/1963 | Wurdack | 114/230 |
| 3,238,912 | 3/1966 | Perlock . | |
| 3,571,836 | 3/1971 | Dunlap . | |
| 4,422,218 | 12/1983 | Brasseux . | |

*Primary Examiner*—Jeffrey V. Nase
*Assistant Examiner*—Thomas J. Brahan
*Attorney, Agent, or Firm*—Wood, Herron & Evans

[57] ABSTRACT

A device for clamping a boat to a post or tree in the water to stabilize the boat against tipping. A clamp which is secured to the boat mounts a hinged shoe which can be brought to bear against the side of the tree. A chain or strap is passed from the shoe around the tree and is tightened down with an toggle lever, thereby rigidly holding the shoe, and hence the boat, to the tree.

11 Claims, 3 Drawing Figures

BOAT STABILIZER

FIELD OF THE INVENTION

This invention relates to a device for clamping a boat to a tree, stump or post in the water, in order to stabilize the boat against tipping and drifting.

BACKGROUND

In fishing and bird shooting from a small boat it is desirable that the boat not tip or rock at critical times, and that it not drift from a particular place. For example, when duck shooting in bayou or marshland it is often desirable to shoot from a standing position in the boat. Most small boats, including even flat bottom boats, do not provide a stable or safe support on which a person can stand upright and shoot safely, let alone accurately. It is especially difficult to stand in an off-center position in a boat without causing it to tip dangerously. In general this has meant that it has been necessary to shoot from a sitting or kneeling position, both for steadiness in aiming and to avoid the chance of tipping.

THE PRIOR ART

Prior attempts have been made to stabilize a boat by locking it to a dock post or to an upstanding tree in the water, as shown in Johnson U.S. Pat. Nos. 2,526,871; Lawler 2,907,294; Perlick 3,238,912; and Dunlap 3,571,836. The previously known devices however have involved impractical, complicated, and/or heavy stabilizing frames.

BRIEF DESCRIPTION OF THE INVENTION

In accordance with this invention a stabilizer is provided which can be clamped onto a small boat, for example at the side rail (gunnel) or stern (transome). The stabilizer includes a shoe or pad which projects outwardly from the boat so as to be engageable against a tree or post. The shoe is hinged so that it can swing, relative to the boat, to bear squarely against the tree regardless of the angulation of the tree or the boat side. A length of chain or strap is attached at one end to the shoe and can be passed around the tree. An over-center or draw-tight lever is provided to pull the chain tight, thereby to hold the shoe securely, and thus to hold the boat securely against the tree, thereby preventing tipping, rocking, and drifting.

It is an advantage of this device that it can readily be fitted onto any type of open boat, regardless of the angulation or shape of the boat sides. Moreover, the devices can be secured against trees of different angulations (including those which are vertical as well as those which project at an angle from the water). When secured, the boat is so stable a person can stand upright safely for shooting. Indeed, one can even walk upright to and stand on the opposite side of the boat from the stabilizer without fear of tipping over or losing one's balance because of excessive rocking. The device can quickly be attached to a tree and requires no auxiliary anchor, support frame or other attachment.

DESCRIPTION OF THE DRAWINGS

The invention can best be further described by reference to the accompanying drawings, in which.

DETAILED DESCRIPTION OF PREFERRED EMBODIMENT

Figure 1:
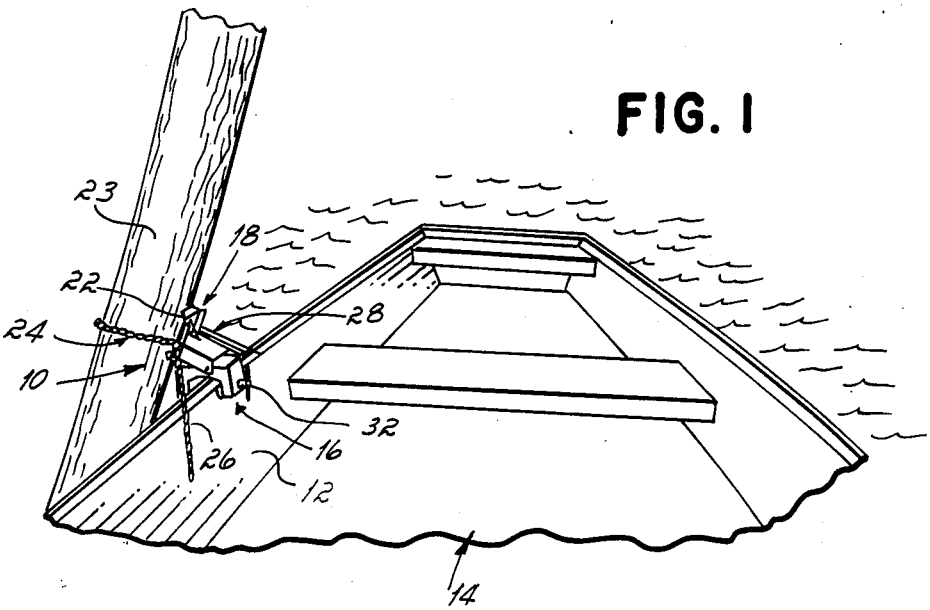
FIG. 1 is an isometric view showing a boat having a clamp in accordance with a preferred embodiment of the invention, as secured to a tree.

The preferred embodiment shown herein for purposes of illustration is pictured mounted to the side rail of a flat bottom fishing boat, however it should be understood that the stabilizer can be mounted elsewhere on the boat if desired, although a centered position on the gunnel is usually the most convenient.

The stabilizer of the invention, designated at 10, is mounted to the side rail 12 of a flat bottom fishing boat 14. The stabilizer generally comprises a mounting or boat gripping means 16 by which it is mounted to boat 14. A foot 18 is pivotally connected to the gripping means at 20, and has a tree-engaging shoe or plate 22 at its outer end. In use, shoe 22 is placed facially against a tree 23, so that foot 18 is at a right angle to the tree. A flexible means such as a chain 24 is relatively attached at one end 26 to the stabilizer, preferably at shoe 22, and at the other end is connected to a tightening means 28 by which chain 24 can be drawn tight once it has been passed around the tree. Tightening means 28 is connected to stabilizer 10, preferably at shoe 22.

Figure 2:
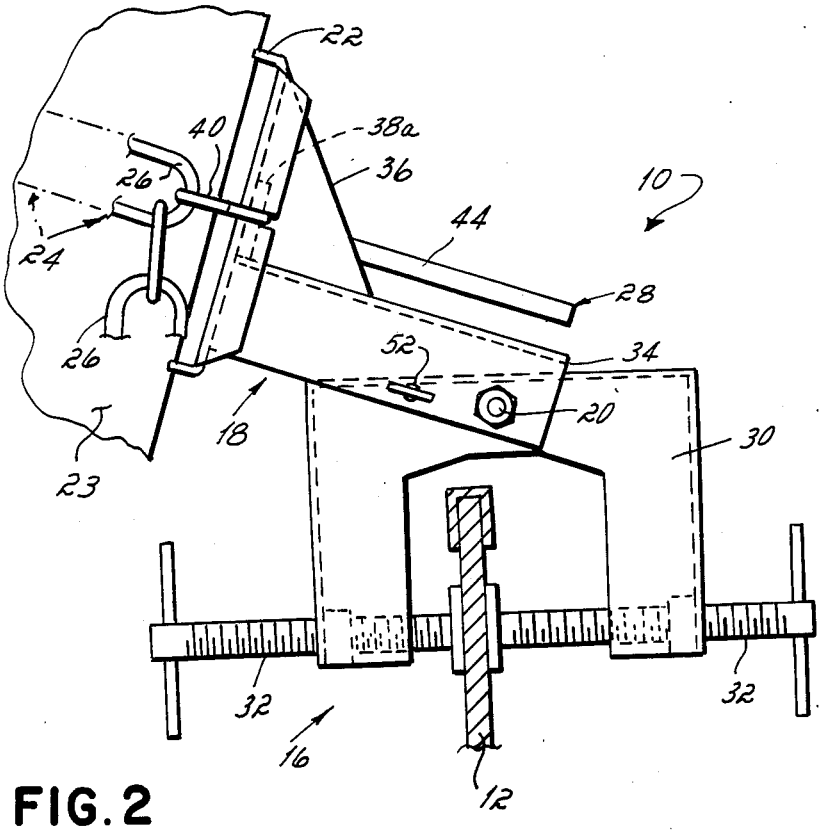
FIG. 2 is an enlarged side elevation of the clamp shown in FIG. 1.

More specifically, the gripping means 16 is preferably in the form of a clamp having a C-shaped body 30 having opposed hand screws 32, 32 which can be tightened against the inside and outside of the hull of boat 14 to mount the clamp securely to the hull. The screw which will go on the outside of the hull (that is, the screw which is below the shoe) may be a little shorter than the opposite screw, so that it will not hit the tree. Foot 18 is suitably a channel member which is pivoted to the top center of clamp body 30 by a bolt or pin which provides the pivot 20. The foot 18 and shoe 22 attached to it are thus swingable relative to the clamp about a horizontal axis which is generally parallel to the side of the boat and perpendicular to the plane of the clamp. The extent of swing is preferably limited between an upward position in which the rear edge 34 of foot 18 abuts the top of body 30 (sse FIG. 2), and a downward position in which the inside of the channel abuts body 30 on the other side of pivot 20. In general I have found it satisfactory if the foot can swing only a small angulation above and below horizontal, for example, upwardly to an elevation of about 26 degrees above the plane of the top of the clamp and downwardly about 10 degrees below the plane of the top of the clamp.

Shoe 22 may suitably be formed from a reinforced channel, and can be cantilevered to the outer end of foot 18. A brace 36 is welded between the top of the shoe 22 and foot 18, since in use the shoe may come under considerable bending strain relative to the foot.

Chain pivot pins 38*a* and *b* are secured to shoe 22 at opposite vertical sides, and one of these pins 38*a* receives an S- or chain hook 40, into which a free link of chain 24 can be releasably hooked. Hook 40 pivots on pin 38*a*.

Figure 3:
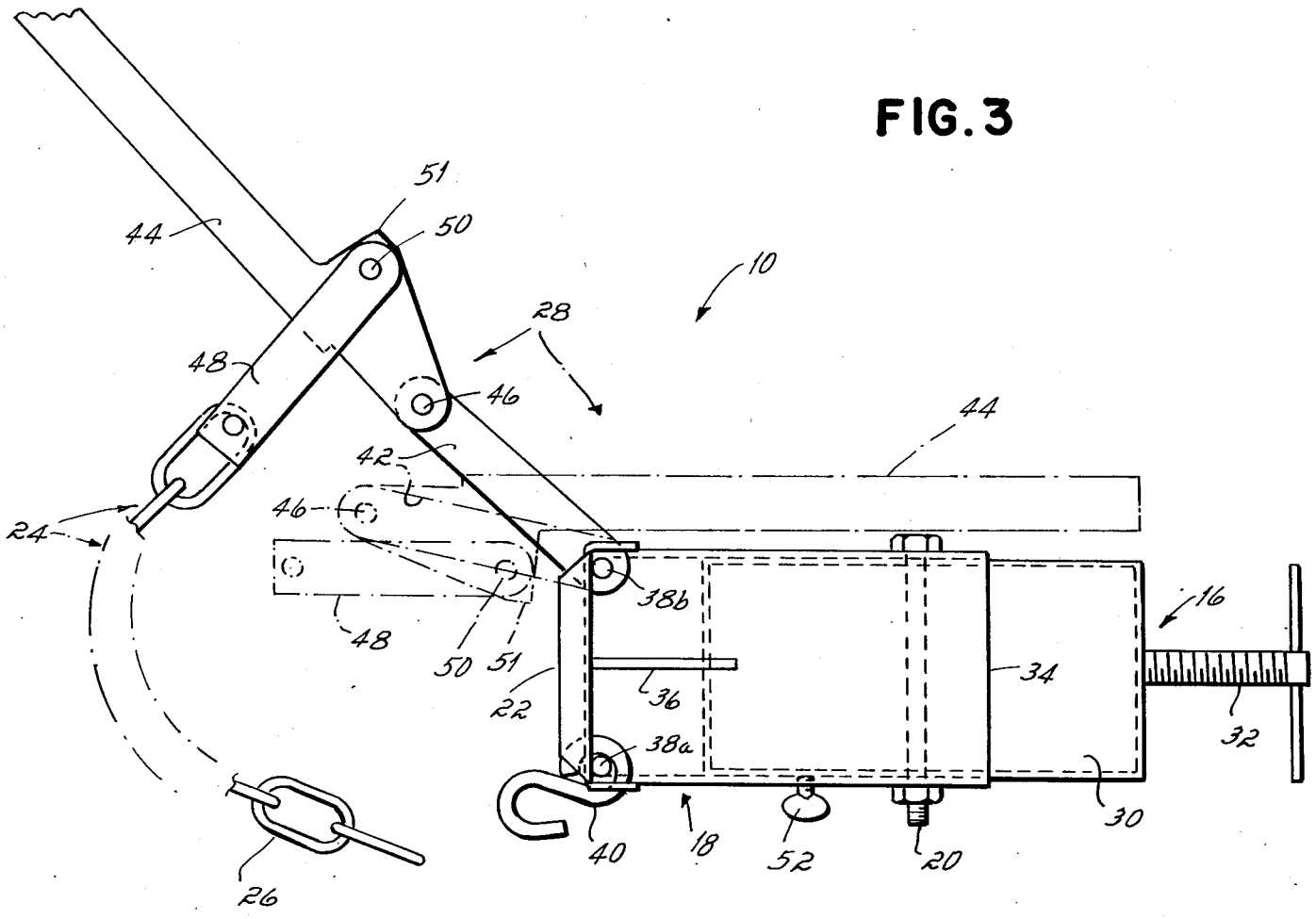
FIG. 3 is a top plan view of the clamp, showing the tightening means in its open and closed positions.

The tightening means 28 is best shown in FIG. 3 and comprises a link 42 which is pivotally received on pivot pin 38*b*; an over-center lever 44 which is pivotally connected at 46 to the outer end of link 42, and a chain connector 48 which is connected at 50 to an offset or shoulder 51 on lever 44. The fixed or second end of chain 24 is connected to the outer end of chain connector 48.

Optionally, an anti-rattle means 52 may be provided to prevent any rattling between foot 18 and the clamp body 30 to which it is pivotally connected. The anti-rattle means 52 may comprise a thumb screw extending inwardly from the side of foot 18, and which can be tightened so that its inner end is brought to bear against the side of clamp body 30, thus taking up any play and preventing any rattling which might be distracting.

In use, the gripping means is positioned on the side of the boat by tightening the opposed screws 32, 32. It is desirable to provide two opposed screws as shown, rather than a single screw, so that the position of the clamp body over the side of the boat can be set laterally as may be desired to position the clamp further outboard or further inboard to fit the situation, although a single screw can be used. It may be useful to place a block of wood between the inside clamp screw end and the hull, to apply the load over a larger area of the hull.

With the clamp in place, foot 18 is swung about its pivot 20 until it is perpendicular to the tree or post and so that the shoe 22 is parallel to and engaged with the side of the tree or other object to which it is to be fastened. A tree of about 8–14 inches diameter is best. The adjustable angulation permits the shoe to be facially engaged with the tree, regardless of angulation of the tree. With lever 44 in the open position shown in FIG. 3, chain 24 is then passed from chain connector 48 around the tree and one of its links is hooked into chain hook 40 so that the chain is snug. The over-center lever 44 is then drawn back parallel to the C-clamp body in the phantom line position shown in FIG. 3, and in doing so provides an over-center action to pull the chain tightly around the tree. (The chain can be rotated one-half turn if the take-up of the lever is insufficient.) Because the lever is an over-center clamp, it remains in the closed position and cannot be accidentally dislodged by boat movement. A hook, not shown, may be provided to hold the lever end against the clamp body for added safety.

Thus attached, the shoe is rigidly fixed to the tree. Although the foot pivots on the stabilizer, the boat can pivot only slightly and dangerous tipping is prevented. Tests have shown that the boat is in fact so stable that it does not tip significantly even when the hunter stands on the opposite end or side of the boat from the clamp, because the boat is essentially clamped to the tree itself.

Having described the invention, what is claimed is:

1. A boat stabilizer for clamping a boat to a tree to stabilizer it against tipping, comprising, gripping means securable to the boat to connect the stabilizer to the boat, a shoe connected to the gripping means, said shoe adapted to seat against the tree, flexible means connected at one end to the stabilizer and adapted to be passed around the tree when the shoe is seated thereagainst, releasable means for securing a second end of said flexible means to said stabilizer after said flexible means has been passed around the tree, and means for tightening said flexible means to secure said shoe to the tree, said stabilizer when clamping the boat to the tree preventing vertical displacement of the gripping means relative to the tree and thereby stabilizing the boat against tipping, said shoe being rigidly mounted at the end of a foot which is pivotally connected to the gripping means for rotation about a horizontal axis, the pivotal connection enabling the position of the shoe to be adjusted to conform to the angulation of the tree, the gripping means being rigidly secured to the boat and the shoe being movable relative to the gripping means only in such pivoting movement.

2. The boat stabilizer of claim 1 wherein said flexible means is a length of chain.

3. The boat stabilizer of claim 1 wherein said flexible means is secured at one end to said shoe.

4. The boat stabilizer of claim 1 wherein said releasable means is a hook which is engageable with said flexible means.

5. The boat stabilizer of claim 1 wherein the means for tightening the flexible means is an overcenter draw-tight.

6. The boat stabilizer of claim 5 wherein said draw-tight is pivotally mounted to said shoe.

7. The boat stabilizer of claim 1 further including an adjustable screw for preventing rattling between relatively movable parts of the stabilizer.

8. A boat stabilizer for clamping a boat to a tree to stabilize it against tipping, comprising, gripping means securable to the boat to connect the stabilizer to the boat, a shoe connected to the gripping means, said shoe adapted to seat against the tree, flexible means connected at one end to the stabilizer and adapted to be passed around the tree when the shoe is seated thereagainst, releasable means for securing a second end of said flexible means to said stabilizer after said flexible means has been passed around the tree, and means for tightening said flexible means to secure said shoe to the tree, said stabilizer when clamping the boat to the tree preventing vertical displacement of the gripping means relative to the tree and thereby stabilizing the boat against tipping, said gripping means comprising a C-clamp which is securable to the gunnel of the boat, said shoe having a foot which is pivoted directly to said C-clamp.

9. A boat stabilizer for clamping a boat to a tree to stabilize it against tipping, comprising, gripping means securable to the boat to connect the stabilizer to the boat, a shoe connected to the gripping means, said shoe adapted to seat against the tree, flexible means connected at one end to the stabilizer and adapted to be passed around the tree when the shoe is seated thereagainst, releasable means for securing a second end of said flexible means to said stabilizer after said flexible means has been passed around the tree, and means for tightening said flexbile means to secure said shoe to the tree, said stabilizer when clamping the boat to the tree preventing vertical displacement of the gripping means relative to the tree and thereby stabilizing the boat against tipping, said tightening means comprising an overcenter draw-tight which is pivotally mounted to said shoe, said shoe being rigidly mounted to a foot which is pivotally connected to said gripping means.

10. The boat stabilizer of claim 9 wherein the amount the foot can swing about its pivotal connection is limited to a small angulation on either side of horizontal.

11. A boat stabilizer for clamping a boat to a tree to stabilize it against tipping, comprising, a clamp securable to the side of the boat, a shoe for seating against the tree, said shoe connected to the clamp by a foot which projects outwardly from the clamp, the clamp being connected to the foot so that the foot can only pivot about a horizontal axis and cannot be displaced laterally or vertically with respect to the clamp, other than by pivoting about said axis, flexible means connected at one end to the shoe and adapted to be passed around the tree when the shoe is seated thereagainst, a hook for securing a second end of said flexible means to said shoe after said flexible means has been passed around the tree, and means for tightening said flexible means around the tree thereby to secure the stabilizer to the tree, said stabilizer when clamping the boat to the tree preventing vertical displacement of said clamp relative to the tree thereby limiting tipping of the boat.

* * * * *